US005854807A

United States Patent [19]

Boisvert et al.

[11] Patent Number: 5,854,807

[45] Date of Patent: Dec. 29, 1998

[54] ELECTRODE FOR SILICON ALLOYS AND SILICON METAL

[75] Inventors: René Boisvert, Ste-Gertrude; Jacques Dostaler, Cap-de-la-Madeleine; Jacques Dubois, Trois-Riviéres; Dieter W. Ksinsik, Town of Mount Royal, all of Canada

[73] Assignee: SKW Canada Inc., Ville St-Laurent, Canada

[21] Appl. No.: 958,323

[22] Filed: Oct. 27, 1997

[30] Foreign Application Priority Data

May 2, 1997 [CA] Canada ..... 2204425

[51] Int. Cl.[6] ..... H05B 7/09

[52] U.S. Cl. ..... 373/89; 373/91; 373/97

[58] Field of Search ..... 373/88, 89, 91, 373/92, 93, 97, 94, 98, 99

[56] References Cited

U.S. PATENT DOCUMENTS

| | | | |
|---|---|---|---|
| 1,440,724 | 1/1923 | Söderberg . | |
| 1,441,037 | 1/1923 | Söderberg . | |
| 1,544,151 | 6/1925 | Helfenstein . | |
| 3,534,004 | 10/1970 | Luvisi | 260/78.5 |
| 3,619,465 | 11/1971 | Cavigli | 13/18 |
| 3,715,439 | 2/1973 | Persson | 13/18 |
| 3,814,566 | 6/1974 | Stroup | 425/144 |
| 3,819,841 | 6/1974 | Persson | 13/18 |
| 4,133,968 | 1/1979 | Frolov . | |
| 4,527,329 | 7/1985 | Bruff et al. | 29/825 |
| 4,575,856 | 3/1986 | Persson | 373/89 |
| 4,692,929 | 9/1987 | Cavigli et al. | 373/89 |
| 4,722,684 | 2/1988 | Kvivik | 432/225 |
| 4,756,004 | 7/1988 | Stanley et al. | 373/89 |
| 5,146,469 | 9/1992 | Svana | 373/89 |
| 5,351,266 | 9/1994 | Bullon Camarasa et al. | 373/89 |

FOREIGN PATENT DOCUMENTS

| | | |
|---|---|---|
| 2081295 | 4/1997 | Canada . |
| 0 372 236 | 6/1990 | European Pat. Off. . |
| 0 700 234 | 3/1996 | European Pat. Off. . |
| 1615418 | 6/1970 | Germany . |
| 40 10 353 | 10/1991 | Germany . |
| 606568 | 7/1960 | Italy . |
| 51-10561 | 4/1976 | Japan . |
| 51-10562 | 4/1976 | Japan . |
| 227822 | 8/1925 | United Kingdom . |

OTHER PUBLICATIONS

New Electrodes For ARC Furnaces by C.F. Fulgenzi—Consultant Electrode Utilization, The ABM Conference Vitoria, Brazil, Dec. 1992.

*Primary Examiner*—Tu Ba Hoang
*Attorney, Agent, or Firm*—Burns, Doane, Swecker & Mathis, L.L.P.

[57] ABSTRACT

The self-baking electrode suitable for use in an electric arc furnace comprises an elongated open ended electrically conductive casing for extending generally vertically within the furnace. A central core made of a heat conductive material is disposed within and spaced from the casing. A framework within is securing the central core to an inner surface of the casing for holding centrally the central core within the casing and for preventing an extrusion of the central core downward. The central core is surrounded by a carbonaceous electrode paste devised to cure into a solid electrode upon heating and to bond to the central core. This self-baking electrode allows the production of silicon metal in a Söderberg-type furnace without any modification to the usual slipping system or addition of another slipping system. An electrode according to the invention allows the same furnace to produce both FeSi of any grade and Si metal without any downtime between the gradual change from one product to the other and each time at the lowest electrode cost.

15 Claims, 3 Drawing Sheets

ELECTRODE FOR SILICON ALLOYS AND SILICON METAL

FIELD OF THE INVENTION

This invention relates to a self-baking electrode for the production of silicon alloys and silicon metal.

BRIEF DESCRIPTION OF THE PRIOR ART

The use of self-baking electrodes (also called "S öderberg electrodes") for the production of ferro-alloys has been known for about 75 years (see U.S. Pat. No. 1,440,724 of September 1919 and U.S. Pat. No. 1,441,037 of January 1923 both in the name of Söderberg). Self-baking electrodes basically consist of a carbon-containing material such as anthracite, pet coke, tar and pitch, which is filled into a steel casing held in position within an electric arc furnace by means of contact shoes and a suspension/slipping device. The application of high electric currents plus the heat of the arc struck by the electrode during the furnace operation develops sufficient heat to melt the material filled into the casing and form a paste, then cokify the so-formed paste, and finally bale the electrode.

The steel casings of the Söderberg electrodes presently in use are in majority round in shape and provided with a series of inwardly projecting fins extending radially towards the center of the electrode in order to provide mechanical strength to the electrode, heat penetration within the electrode through the conductivity of the fins and act as current conductor. The fins and the casing are typically made of regular steel, and their amount, length and physical shape depend on what is considered optimum for thorough baking as per each geometric design.

As the electrode is consumed during the production of silicon or ferro-alloy, both the paste and casing have to be replaced. This is done high on top of the electrode column so that there is sufficient static pressure for compaction, and for running through the various stages of the temperature pattern from softening of the paste up to the heat generated by current flow.

Consumption of the electrode is compensated by regular slipping of the electrode through the contact shoes. The iron casing and the fins passing down the contact shoes at each slipping burn and oxidize or melt, and thereby fall into the mix. Because of this consumption/oxidation, the iron pick-up is of such a magnitude that the Söderberg technology cannot be applied to produce commercial grade silicon metal where, depending on the quality grade for Si, the Fe content has to be below 1%, below 0.5%, below 0.35% or even below 0.2%.

Therefore, so far, silicon metal has been produced exclusively by using a so-called "pre-baked" electrode, which is an amorphous carbon or semi-graphitized electrode produced in specific manufacturing units and then supplied in sections of typically 2 to 2.5 m length. These pre-baked electrodes, which are usually 4 to 6 times more expensive than Söderberg electrodes, are to be connected to each other by specific devices, which can be nipples and sockets or a system of male/female design cuts at the ends of each section of the electrode. In operation in a silicon metal furnace, these connections between pieces of electrodes are limiting factors for energy transfer from one electrode to the other underneath the contact shoe.

Because of the heat and current transfer pattern, nipples and sockets are prone to breaking with abrupt changes of power in the furnace —as caused by any type of power shutdown — so that electrode breakages are part of undesired negative influences on operation.

Furthermore, their strength is relatively low as compared to the Söderberg electrodes, which do not contain the weak spots due to connectors or nipples, making it more solid and accepting higher specific power per square section.

Therefore, reduction of electrode costs using the self-baking principle is one of the main challenges of every silicon metal producer.

Many attempts have been undertaken to develop a type of Söderberg electrode which would allow a cheaper production of silicon metal while meeting all the criteria for reducing the amount of iron in the produced metal.

In the 70', Nippon Denko of Japan developed a system in which the casings and fins usually made of steel were replaced by casings and fins made of aluminum (see Japanese Patents nos. 951,888 and 835,596). This attempt to use aluminum for both the casing and fins has never been used industrially, because of the lack of mechanical stability and the substantially different conductivity of aluminum compared to steel.

Another approach was undertaken by M. Cavigli (see Italian Patent no. 606,568 of July 1960). In this patent, it was suggested to remove the fins from the outer casing and to adjust the relative movement of the paste with respect to the outside casing by sliding or extruding the inner contents of the casing as a central consumable member. Iron crosses were provided within the casing to support the electrode while it baked. These iron crosses held the electrode while allowing a relative movement between the casing and the electrode by either pressing or reducing the suspension weight. This system has been in operation in one plant in Italy. It permits to reduce the iron contamination, as the slipping of the casing represents only 1/10 of the slipping of the electrode itself. However, it does not permit to reach the same low level in iron impurities as obtained with conventional pre-baked electrodes.

Another approach has been undertaken by Bruff (see U.S. Pat. No. 4,527,329 of July 1985). This patent suggests to separate the baking of the paste from the one that takes place by the application of heat through Ohm's resistance and conductivity in and below the contact shoes. Thus, a separate baking installation is located way above the contact shoes. Moreover, a device is provided to cut and remove the iron casing underneath the baking system, well above the contact shoes, so that basically a shaped pre-baked-like electrode enters the contact shoes. This system operates in a small furnace of about 10 MW at Elkem Kristiansand. However, there are severe restrictions in the use for higher powered furnaces with larger diameter electrodes, which are the manufacturing standard for cost efficiency in the developed world.

A similar solution has also been disclosed in German Patent Application no. 4,036,133 of May 1991 in the name of E. Svana.

A further system based on a relative movement of a self-baking electrode with respect to an external casing has been disclosed by Persson in U.S. Pat. No. 4,575,856 of March 1986. In this patent, the iron crosses used by Cavigli in his system are replaced by smaller graphite electrodes put concentrically into the casing. The small electrodes are supported and moved by a separate slipping/holding device, which allows their relative movement within the casing.

An improved system based on a "transfer" from a conventional pre-baked electrode to one of the extruded type as described by Cavigli and Persson is described in Canadian patent no. 2,081,295.

The disadvantages of this system mainly result from the physical strength limitations of the graphite electrode core and its limited potential to absorb compression, tension and bending forces as the electrode core is essentially unguided over lengths of up to 14 m and can deviate from its vertical position for various reasons. Furthermore, the casing which, in this system, is essentially an extrusion dye, needs to be slipped down occasionally to compensate for heat damages is between and underneath the contact shoes. Without such periodic slipping, damages would reach high up in the contact shoes, and liquid paste would start to drip and thereby provoke disturbances known as "green" breakages in the Söderberg technology. The periodic slippings of the casing do slightly contaminate the Si not only with the iron of the casing, but also with the alloying elements used in the casing material to provide the maximum possible heat oxidation protection. These contaminants tend to make silicon metal produced this way unsuitable for its application in the chemical industry to produce methylchlorosilanes out of silicon metal. Casings made of regular steel also have their disadvantages as vital properties for functioning are decreased by heat, the furnace atmosphere and the time they are exposed to those.

OBJECTS OF THE PRESENT INVENTION

It is a object of the present invention to provide a new and improved self-baking electrode.

Another object of the present invention is to provide a new electrode system which allows the production of silicon metal in a Söderberg-type furnace without any modification to the existing slipping system or addition of another slipping system. Thanks to the electrode according to the invention, the same furnace can produce both FeSi of any grade and Si metal without any downtime between the gradual change from one product to the other and each time at the lowest electrode cost.

The electrode according to the invention overcomes the problems associated with prior art: silicon metal contamination, core breakages as a result of extrusion forces, casing deformation, loss of production and capital expense for installation of new slipping systems. It also provides a way to convert bigger and more efficient ferrosilicon Söderberg-type furnaces instead of existing silicon metal furnaces with pre-baked electrode technology.

SUMMARY OF THE INVENTION

Accordingly, the present invention relates to an in situ self-baking electrode suitable for use in an electric arc furnace, the electrode comprising:

an elongated open ended electrically conductive casing that extends generally vertically within the furnace in use;

a central core disposed within and spaced from the casing, the central core being made of a heat conductive material;

at least one framework within the casing, the framework securing the central core to an inner surface of the casing for holding centrally the central core within the casing and for preventing an extrusion of the central core downward; and a carbonaceous electrode paste surrounding the central core, the paste being devised to cure into a solid electrode upon heating and to bond to the central core.

The present invention also relates to an electric arc furnace embodying a self-baking electrode as described hereinbefore.

A further object of the present invention is to propose a process for forming in situ a self-baking electrode in an electric arc furnace, the process comprising the steps of:

a) providing an elongated open ended electrically conductive casing;

b) disposing an elongated central core of conductive heat material within and spaced from the casing;

c) securing the central core to an inner surface of the casing and holding it centrally within the casing;

d) sliding the elongated electrically conductive casing within the furnace for extending generally vertically therein;

e) introducing a quantity of carbonaceous electrode paste in the casing and surrounding the central core, the paste being devised to cure into a solid electrode upon heating and to bond to the central core; and e) providing an electric arc to the furnace.

The central core of the electrode preferably consists of carbon or carbidic bars or rods connected to each other so that the heat transfer is essentially uninterrupted in their connection. Use can also be made of metal rods or bars.

Whatever be the material used for the manufacture of the central core, such a core in the form of bars or rods can be hollowed to allow inside cooling through injection of di-atomic or inert gases. Such is particularly useful to control and influence the arc at the tip of the electrode and the baking of the electrode.

In accordance with the invention, the material forming the casing is selected so as to be electrically conductive to transfer electric power from the contact shoes into the S öderberg paste while preferably preventing undesired metallic contamination by either Ti, V, Ta, Cr, Zr or Ni. Advantageously, the casing can be made of Cu or brass, or of an aluminum alloy or aluminum of sufficient strength to support the pressure of the filling of Söderberg paste without deformation or dents.

Such a possible selection makes the invention particularly useful to produce silicon metal of suitable quality for application in the Rochow-direct synthesis. Indeed, one has only to select the material forming the conductive core and supporting casing so that the resulting metallic additions to the melting contains suitable amounts of Al and/or Cu and/or zinc and/or tin as are required in the silicon thus produced.

Advantageously, the electrode according to the invention allows a user to switch from the production of ferrosilicon using regular Söderberg electrodes to the production of silicon metal using the technology described hereinabove, without any downtime, and since no additional devices to guide the graphite core are required, switch-back to S öderberg technology is possible and only with this technology.

As can be appreciated, an important improvement in the electrode according to the invention lies in that the central core of the electrode which is secured to the casing is "released" from its function of transferring compression forces for the extrusion as for the electrode described in prior art as indicated above. Consequently, it does not expose the core material to the risk of buckling when compressed, and thereby of breaking. It furthermore eliminates the need for a separate slipping device to perform the functions of the central core, and thereby the substantial costs for irreversible retrofitting of existing furnaces from the pre-baked carbon-electrode design to the extruded concept as described hereinabove. Furthermore, it allows a much safer application of a hollow core electrode, where in the case of the extruded principle, the presence of such a central hole in the central core further weakens mechanically the core in cross section, in particular at the level of the nipples or connectors, with an even more pronounced susceptibility to breakages or damages in the column while performing the extrusion increments.

A non restrictive description of a preferred embodiment will now be given with reference to the appended drawings.

DESCRIPTION OF A PREFERRED EMBODIMENT

Figure 1:
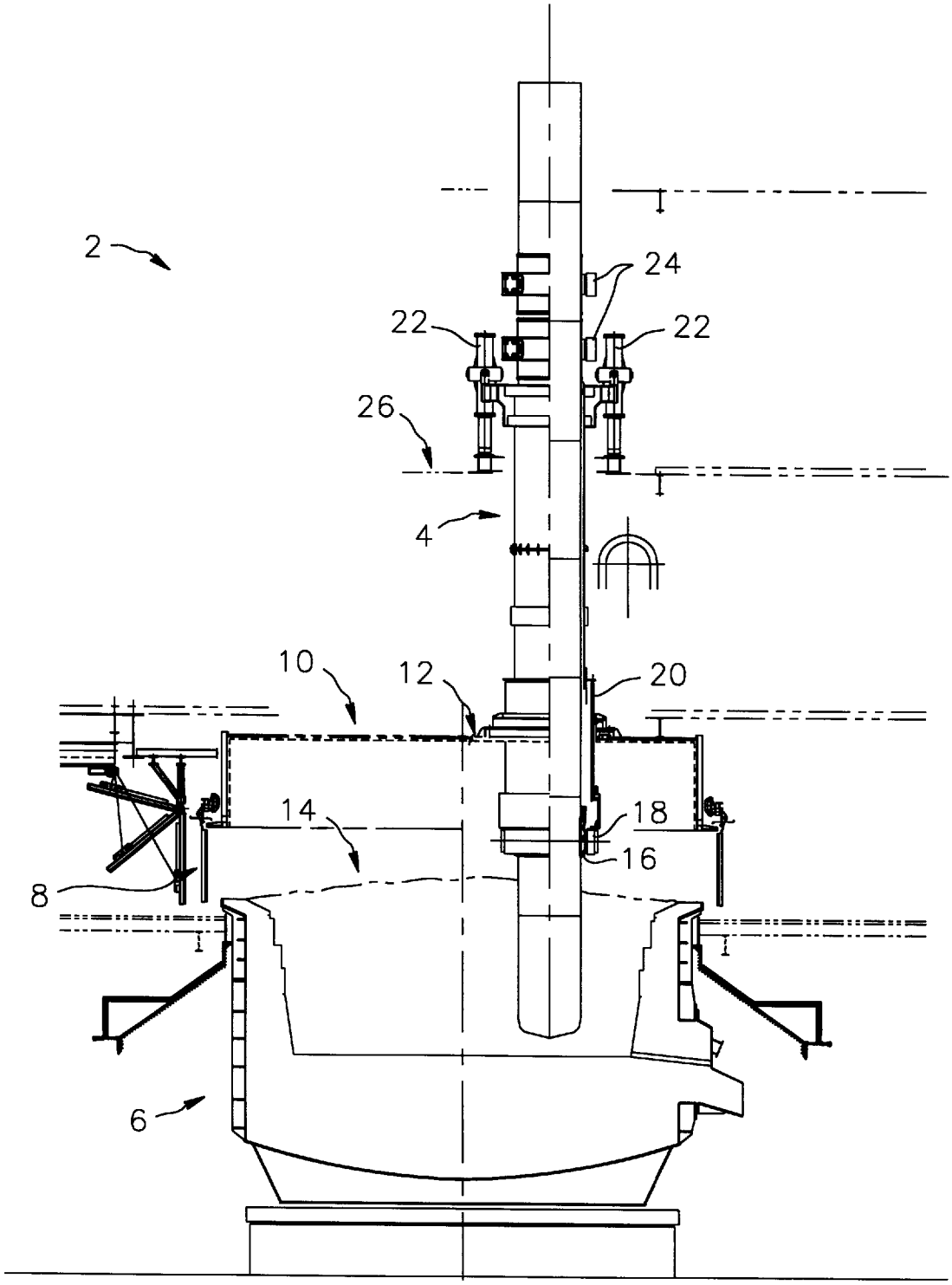
FIG. 1 is a side elevational view, partly in section, schematically illustrating an electric arc furnace in which an electrode according to the present invention is used.

Referring to FIG. 1, an electric arc furnace (2) in which an electrode (4) according to the present invention may be employed is illustrated. The furnace (2) is of a conventional design and may be used for smelting for example, ferrosilicon and silicon metal. As well known in the art, the furnace (2) comprises a furnace body (6) formed of an outer steel shell and a suitable refractory material. A curtain (8) is extending upwardly from the furnace body (6) and it has an upper end engaged by the hood (10) or cover of the furnace body (6). The electrode (4) extends vertically within the furnace body (6) through an opening (12) in the hood (10). The furnace (2) comprises electric means for providing an electric arc in the furnace (2) for smelting a charge (14) in the furnace body (6). The electric means comprises a contact, such as a contact shoe (16) , connected to the electrode (4). The contact shoe (16) is mounted on the electrode (4) with a conventional half-ring (18). The furnace (2) may also be provided with a water-cooled jacket (20) for cooling the electrode (4) above the contact shoe (16). Retaining means are provided for retaining the electrode (4) vertically within the furnace (2). The retaining means preferably comprises regulation cylinders (22) and two slipping bands (24) mounted on an upper floor (26) of the furnace building and supporting the electrode (4).

Figure 2:
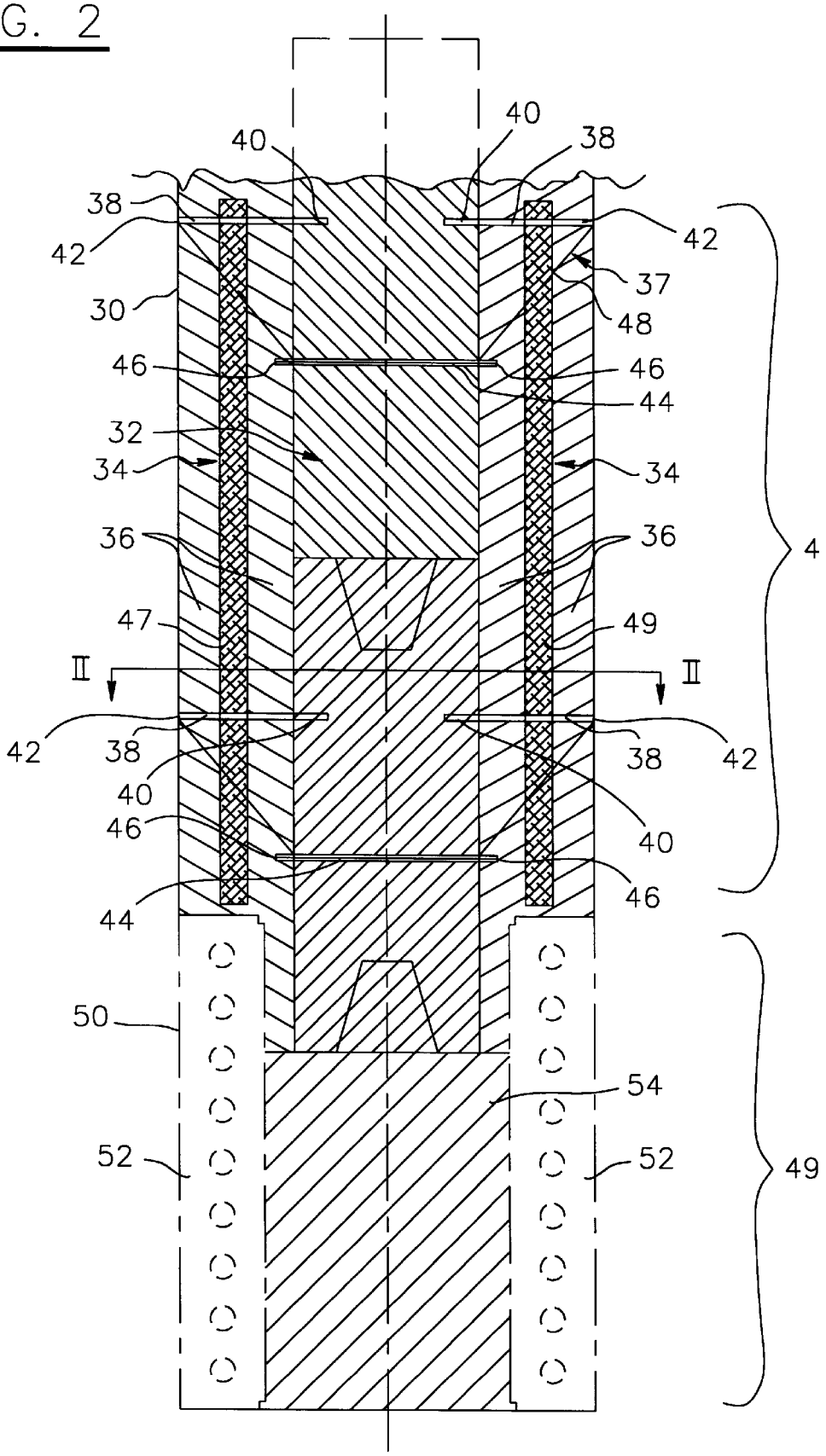
FIG. 2 is a side elevational cross-section view of an electrode according to a preferred embodiment of the invention, shown above a conventional Söderberg electrode.
Figure 3:
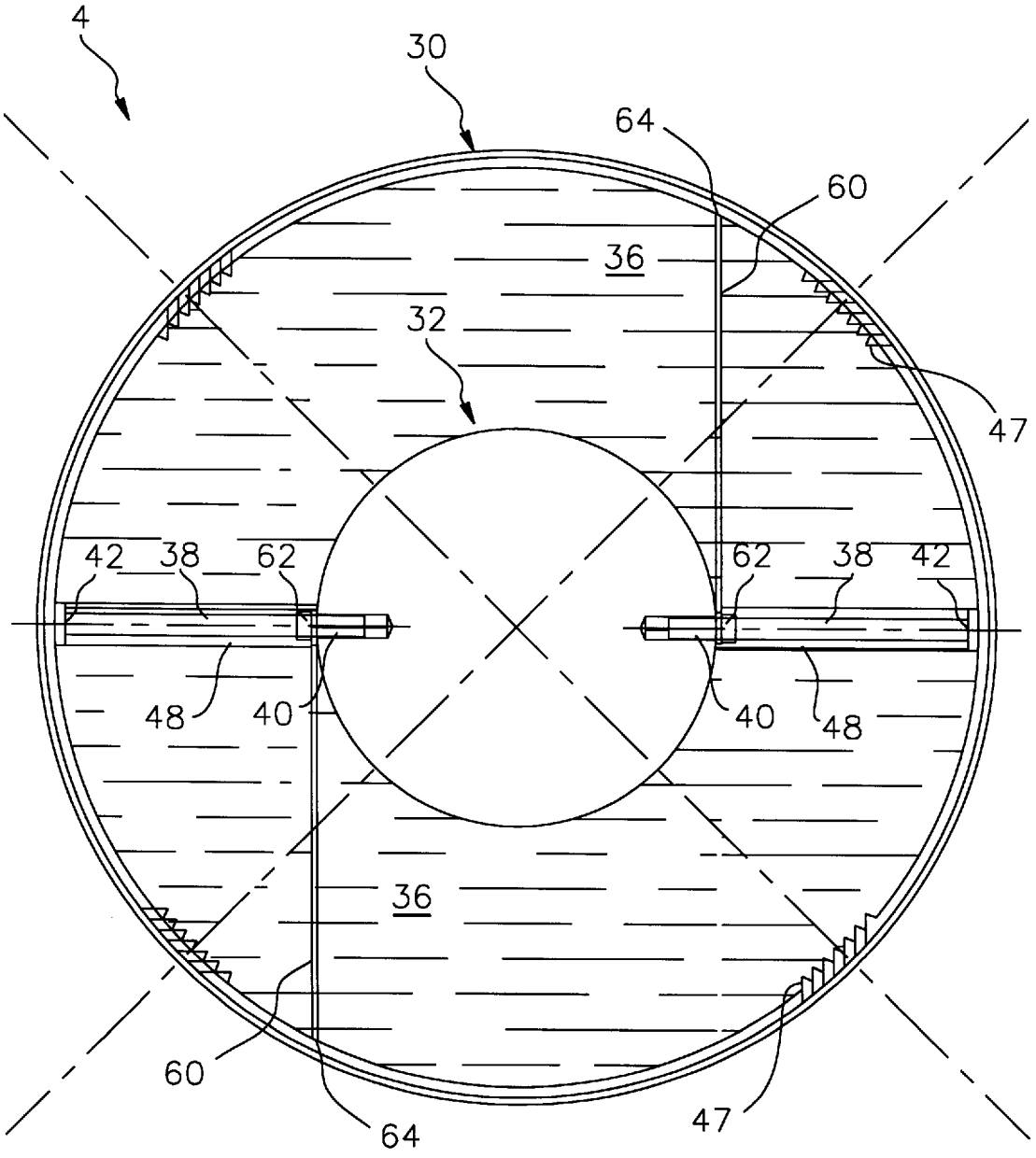
FIG. 3 is a cross section view of the electrode of FIG. 2, taken along line II—II in FIG. 2.

Referring more particularly to FIGS. 2 and 3, the self-baking electrode (4) according to the present invention comprises an elongated open ended electrically conductive casing (30) for extending generally vertically within the furnace (2) in use. A central core (32) made of a heat conductive material, preferably made of a carbonaceous material, is disposed within and spaced from the casing (30). The casing (30) and the central core (32) define an annular channel (34) in which a carbonaceous electrode paste (36), preferably Söderberg paste, can be fed, molten and baked. In other words, a carbonaceous electrode paste (36) is surrounding the central core (32), the paste (36) being devised to cure into a solid electrode upon heating and to bond to the central core (32).

The central core (32) can be shaped as a bar or other defined shapes and is held centrally within the casing (30) by at least one framework (37) which prevents relative movement of the central core (32) with respect to the casing (30) due to the paste movement between the core (32) and the casing (30).

Preferably, the casing (30) is made of a thin-walled ordinary steel or a thicker-walled Dural® so that the rigidity of the walls can stand the radial pressure of the filled-in S öderberg paste (36). The filling of the Söderberg paste (36) into the electrode casing (30) is done in a quasi continuous manner so as to minimize the "falling" height and also the total length above the contact shoes.

In case where silicon metal is to be produced in the furnace (2), the casing (30) is preferably made of a material unalloyed with a metal selected from the group consisting of titanium, vanadium, tantalum, chrome, zirconium and nickel, for preventing contamination of the silicon metal to be produced in the furnace (2) with one of said metal upon an ongoing consumption of the casing in the furnace (2).

More preferably in this case, the casing (30) is made of a metal selected from the group consisting of copper, brass and aluminum.

As shown in FIGS. 2 and 3, the framework (37) securing the central core (32) to an inner surface of the casing (30) preferably comprises a pair of opposite rods (38), each rod (38) extending generally horizontally and having a first end (40) driven into the central core (32) and a second end (42) secured to an inner surface of the casing (30). A bar (44) is extending through the central core (32) below the pair of rods (38), the bar (44) having its opposite outer ends (46) projecting out from the central core (32). The framework (37) further comprises two lateral frame members (48), each connecting together the second end (42) of each rod (38) to a corresponding outer end (46) of the bar (44). Referring to FIG. 3, two further rods (60) may preferably be provided for preventing the central core (32) from twisting or rotating within the casing (30). Each of said rods (60) comprises a first end (62) secured to the central core (32) and a second end (64) secured to the inner wall of the casing (30), the two rods (60) being tangent with the central core (32).

Although not essential, spread-out sheets (47) may be fixed to the inner surface of the casing (30) to better prevent an extrusion of the baked paste (36) downward. However, experiments have shown that the framework (37) alone prevents very well any extrusion of the baked electrode (36) downward, the baked electrode (36) bonding against the framework (37).

Referring to FIG. 2, a conventional Söderberg electrode (49) is illustrated below the electrode (4) according to the present invention. This conventional Söderberg electrode (49) comprises a casing (50) and fins (52) mounted on the inner wall of the casing (50). A self-baked electrode (54) is formed within the casing (50) and both the electrode (54) and casing (50) moved down in unison. This type of electrode is well known in the art and does not need further description. As can be appreciated, this conventional S öderberg electrode (48) may have the same diameter as the diameter of the electrode (4) according to the invention, showing that it is possible to easily switch from the production of ferrosilicon using a regular Söderberg electrode (49) to the production of a silicon metal using an electrode according to the invention without any downtime or shutdown of the whole furnace.

The particular structure of the electrode according to the invention allows for a great reduction in the volume of metal, such as steel, that is normally used for preventing the extrusion of the self-baked electrode downwards. As a matter of fact, with the electrode according to the invention, it is possible to obtain a silicon metal containing less than 0.5% Fe, with a casing still made of steel.

Extensive studies of the baking pattern of both a conventional Söderberg electrode and a compound electrode where the center of the electrode is of a solid material having a substantially different thermal and electrical conductivity have shown that when the electrode comprises a central core with a high conductivity, the heating and baking pattern is higher in the contact shoe area as compared to the conventional Söderberg technology. More specifically, baking of the paste occurs from the centre of the high heat conducting solid core against the surrounding Söderberg paste towards the casing. In contrast, with a conventional Söderberg electrode, baking of the paste occurs from the casing and the fins, that is from the outside of the electrode, toward the inside of the same, as this is not a different conductivity between the core and the Söderberg material.

The present invention uses, in a well balanced system, the heat conductivity of the central core (32) to bake the surrounding Söderberg paste (36). It does not necessitate a relative movement of the baked electrode (36) with respect to its surrounding casing (30) as is the case with the compound electrodes known in prior art and for use in the silicon metal production.

The process for forming in situ a self-baking electrode (4) in an electric arc furnace (2), according to the present invention, comprises the following sequence of steps.

a) An elongated open ended electrically conductive casing is provided.

b) An elongated central core (32) of conductive heat material is disposed within and spaced from the casing (30).

c) The central core (30) is secured to an inner surface of the casing (30) and held centrally within the casing (30).

d) The elongated electrically conductive casing (30) is slid within the furnace (2) for extending generally vertically therein.

e) A quantity of carbonaceous electrode paste (36) is introduced in the casing (30) surrounding the central core (32). The paste (36) is devised to cure into a solid electrode upon heating and to bond to the central core (32).

f) An electric arc is present in the furnace (2) in a well know manner which do not need further description.

Preferably in step c), the central core (32) is secured to the casing (30) by driving respectively into two opposite sides of the central core (30), a first end (40) of a corresponding rod (38) of a pair of opposite rods (38) and then securing a second end (42) of each of said opposite rods (38) to an inner surface of the casing (30) such that each rod (38) is extending generally horizontally within the casing (30). A bar (44) is inserted through the central core (32) below the two rods (38) such that the opposite outer ends (46) of the bar (44) are projecting out from the central core (32). The second end (42) of each rod (38) is respectively connected to a corresponding outer end (46) of the bar (44) with a lateral frame member (48).

In the case where the electrode (4) formed is used for the production of silicon metal, the casing (30), in step d), may preferably be slid on top of a previous Söderberg-type self-baking electrode (49) used for the production of ferrosilicon, as shown in FIG. 2. In this case, the casing (30) used for the production of silicon may have substantially the same diameter as the outer casing (50) of the Söderberg electrode (48). As mentioned before, one can see that it is possible to easily switch from the production of ferrosilicon using a regular Söderberg electrode (48) to the production of a silicon metal using an electrode according to the invention without any downtime or shutdown of the whole furnace.

Although a preferred embodiment of the invention has been described hereinbefore and illustrated in the accompanying drawings, it is to be understood that the invention is not limited to this precise embodiment and that various changes and modifications may be effected therein without departing from the scope of the present invention.

What is claimed is:

1. An in situ self-baking electrode suitable for use in an electric arc furnace, the electrode comprising:

an elongated open ended electrically conductive casing that extends generally vertically within a furnace;

a central core disposed within and spaced from the casing, the central core being made of a heat conductive material;

at least one framework within the casing, the framework securing the central core to an inner surface of the casing for holding centrally the central core within the casing and for preventing an extrusion of the central core downward; and a carbonaceous electrode paste surrounding the central core, the paste being devised to cure into a solid electrode upon heating and to bond to the central core.

2. An in situ self-baking electrode as defined in claim 1, wherein the casing is made of a material unalloyed with a metal selected from the group consisting of titanium, vanadium, tantalum, chrome, zirconium and nickel for preventing contamination of a product to be produced in the furnace with any of said metal upon an ongoing consumption of the casing in the furnace.

3. An in situ self-baking electrode as defined in claim 2, wherein the central core is made of a carbonaceous material.

4. An in situ self-baking electrode as defined in claim 3, wherein the casing is made of a metal selected from the group consisting of copper, brass and aluminum.

5. An in situ self-baking electrode as defined in claim 2, wherein the at least one framework comprises:

a pair of opposite rods, each rod extending generally horizontally and having a first end driven into the central core and a second end secured to an inner surface of the casing;

a bar extending through the central core below the pair of rods and having opposite outer ends projecting out from the central core; and two lateral frame members, each connecting together the second end of each rod to a corresponding outer end of the bar.

6. An in situ self-baking electrode as defined in claim 5, wherein the central core is hollowed for allowing inside cooling through injection cooling gases.

7. An electric arc furnace comprising:

a furnace body containing a charge to be heated;

an in situ self-baking electrode comprising:

an elongated open ended electrically conductive casing having an upper end and a bottom end, said casing extending generally vertically within the furnace body and being free to slip vertically through a slipping mechanism;

a central core disposed within and spaced from the casing, the central core being made of heat conductive material;

at least one framework within the casing, the framework securing the central core to an inner surface of the casing for holding centrally the central core within the casing and for preventing an extrusion of the central core downward through the bottom end of the casing;

a carbonaceous electrode paste surrounding the central core, the paste being devised to cure into a solid electrode upon heating and to bond to the central core;

means for retaining the casing in a generally vertical position within the furnace body; and electric means for generating an electric arc in the furnace, the electric means comprising a contact on the casing.

8. An electric arc furnace as defined in claim 7, wherein the casing is made of a material unalloyed with a metal selected from the group consisting of titanium, vanadium, tantalum, chrome, zirconium and nickel for preventing contamination of a product to be produced in the furnace with any of said metal upon an ongoing consumption of the casing in the furnace.

9. An electric arc furnace as defined in claim 8, wherein the central core is made of a carbonaceous material.

10. An electric arc furnace as defined in claim 9, wherein the casing is made of a metal selected from the group consisting of copper, brass and aluminum.

11. An electric arc furnace as defined in claim 10, wherein the at least one framework comprises:

a pair of opposite rods, each rod extending generally horizontally and having a first end driven into the central core and a second end secured to an inner surface of the casing;

a bar extending through the central core below the pair of rods and having opposite outer ends projecting out from the central core; and two lateral frame members, each connecting together the second end of each rod to a corresponding outer end of the bar.

12. An electric arc furnace as defined in claim 11, wherein the central core is hollowed for allowing inside cooling through injection cooling gases.

13. A process for forming in situ a self-baking electrode in an electric arc furnace, the process comprising the steps of:

a) providing an elongated open ended electrically conductive casing;

b) disposing a central core of conductive heat material within and spaced from the casing;

c) securing the central core to an inner surface of the casing and holding it centrally within the casing;

d) sliding generally vertically the elongated electrically conductive casing within the furnace;

e) introducing a quantity of carbonaceous electrode paste in the casing so that said paste surrounds the central core, the paste being devised to cure into a solid electrode upon heating and to bond to the central core; and f) contacting the casing to an electric power source; and g) generating with said electric power source an electric arc into the furnace.

14. A process as defined in claim 13, wherein step c) comprises the steps of:

driving respectively into two opposite sides of the central core a first end of a corresponding rod of a pair of opposite rods and securing a second end of each of said opposite rods to an inner surface of the casing such that each rod is extending generally horizontally within the casing;

inserting a bar through the central core below said two rods and such that opposite outer ends of said bar are projecting out from the central core; and connecting together with a respective lateral member, the second end of each rod to a corresponding outer end of the bar.

15. A process as defined in claim 13, wherein:

the electrode that is formed is used for the production of silicon metal;

in step d), the casing is connected on top of a previous self-baking electrode used for the production of ferrosilicon, said previous electrode comprising an outer casing; and the casing of the electrode that is formed has substantially the same diameter as said outer casing of the previous electrode.

* * * * *